US005451108A

United States Patent [19]

Anderson

[11] Patent Number: 5,451,108

[45] Date of Patent: Sep. 19, 1995

[54] CONTAINER

[76] Inventor: Bruce Anderson, 2/25 Best Street, Lane Cove, N.S.W. 2066, Australia

[21] Appl. No.: 41,486

[22] Filed: Apr. 1, 1993

[30] Foreign Application Priority Data

Apr. 1, 1992 [AU] Australia ..... PL1649

[51] Int. Cl.[6] ..... B65D 30/22; B65D 33/16

[52] U.S. Cl. ..... 383/38; 383/41; 383/67

[58] Field of Search ..... 383/38, 40, 41, 67

[56] References Cited

U.S. PATENT DOCUMENTS

| | | | |
|---|---|---|---|
| 503,858 | 8/1893 | Katzer | 383/41 |
| 1,207,533 | 12/1916 | Gamble | 383/67 |
| 1,748,087 | 2/1930 | Spanel | 383/41 |
| 2,500,341 | 3/1950 | Burnett | 383/40 |
| 2,585,214 | 2/1952 | Belmont | 383/43 |
| 2,654,527 | 10/1953 | Geckler et al. | 383/40 |
| 3,374,929 | 3/1968 | Silfverskiold | 383/41 |
| 3,789,897 | 2/1974 | Saito | 383/41 |
| 3,797,734 | 3/1974 | Fleury et al. | 383/40 |
| 3,949,901 | 4/1976 | Tokita | 383/41 |
| 4,008,806 | 2/1977 | de Paez et al. | 383/41 |
| 5,050,998 | 9/1991 | Wachtel | 383/67 |

FOREIGN PATENT DOCUMENTS

| | | | |
|---|---|---|---|
| 1009624 | 6/1952 | France | 383/41 |
| 3716556 | 11/1987 | Germany | 383/38 |

*Primary Examiner*—Stephen P. Garbe
*Attorney, Agent, or Firm*—Brown, Martin, Haller & McClain

[57] ABSTRACT

A container adapted to neatly store plastic film bags and like articles in different compartments according to their size, the container comprising a tubular body for bags of one size and having an inlet and outlet aperture, and at least one pocket for bags of a different size, the pocket also having an inlet and outlet aperture. The bags are contained within the tubular body and pocket preferably by means of a resiliently expandable cuff at the respective outlet apertures.

7 Claims, 1 Drawing Sheet

CONTAINER

FIELD OF THE INVENTION

The present invention relates to a container, and more particularly to a container adapted to contain articles such as plastic film shopping bags.

BACKGROUND ART

It is common practice for supermarkets and similar retail outlets to provide shopping bags formed from plastic film to shoppers for carrying away goods they have purchased. Such shopping bags are often retained by the shopper for subsequent use in the home or in the garden. A common problem encountered is how to conveniently store such plastic film shopping bags between the time they are emptied of their original contents and the time that they are required for some subsequent purpose. The relatively flimsy nature makes then difficult to conveniently pack into drawers. The problem has been addressed to some degree by the use of tubular bags having one open end through which the plastic bags can be deposited into the tubular bag and an elasticized cuff at the other end, for withdrawing bags one at a time.

These tubular bags however only partially solve the problem associated with plastic bags to be stored for re-use as plastic bags come in a variety of sizes. For instance small bags typically used to separate individual products are generally not reusable for the same purposes as are the larger carry bags, although they are typically reusable for other purposes, and thus the two types of bags are not conveniently stored together.

The present invention sets out to better solve the problems associated with storing the plastic bags for reuse.

DISCLOSURE OF THE INVENTION

The present invention consists in a container adapted to contain plastic film bags and like articles comprising:

a tubular body having an inner and outer surface and having at one end an inlet aperture through which ones of said articles may be deposited and at the other end an outlet aperture through which the articles in the container may be withdrawn one at a time;

at least one pocket being generally integral with the tubular body and having a pocket inlet aperture at one end of the pocket and through which said articles may be deposited and a pocket outlet aperture at an opposite end of said pocket and through which the articles in the pocket may be withdrawn one at a time; and wherein said inlet aperture and pocket inlet aperture, and said outlet aperture and pocket outlet aperture, are respectively sufficiently separated so that said articles can be selectively stored in, and removed one at a time from, said tubular body and said pocket according to a classification criteria.

The classification criteria is preferably the general approximate size of the articles.

The container is preferably produced from a sewable fabric and the pocket is sewn to either one of the inner or outer surfaces of the tubular body and extending about a portion of the circumference of the tubular body.

At least one of the outlet aperture and pocket outlet aperture preferably includes an elasticized cuff or the like partial closure.

The inlet aperture may preferably be closed by a drawstring or like structure.

In one embodiment the container may be formed from a sheet material such as plastic film which is preferably joined by gluing along its lateral edges to form a tube. The inlet aperture is preferably formed at one end of the tube by a drawstring which can be drawn tight to close the inlet aperture of the tube. The other end of the tube is preferably provided with an elasticized cuff defining an outlet aperture. The elasticized cuff is preferably so dimensioned that the cuff in its relaxed condition defines an aperture in the outlet end of the container of from about 5 mm to about 30 mm, and is preferably expandable to a diameter of 25 to 100 mm so as to release the bags from the container one at a time when pulled from outside the container.

In use the inlet end of the container may be opened by loosening the drawstring and inserting used plastic film shopping bags in a crumpled condition into the main body of container or by placing smaller individual goods bags into the pocket. The container may be retained in a draw or suspended from the drawstring. When a used plastic film shopping bag is required it is possible to grasp the lowermost shopping bag in the container through the outlet aperture and draw that bag from the container. The resiliently expandable nature of the outlet aperture is such that other shopping bags in the container are retained therein as the one bag is drawn from the container.

BRIEF DESCRIPTION OF THE DRAWINGS

Hereinafter given by way of example only is a preferred embodiment of the present invention described with reference to the accompanying drawings in which.

Figure 1:
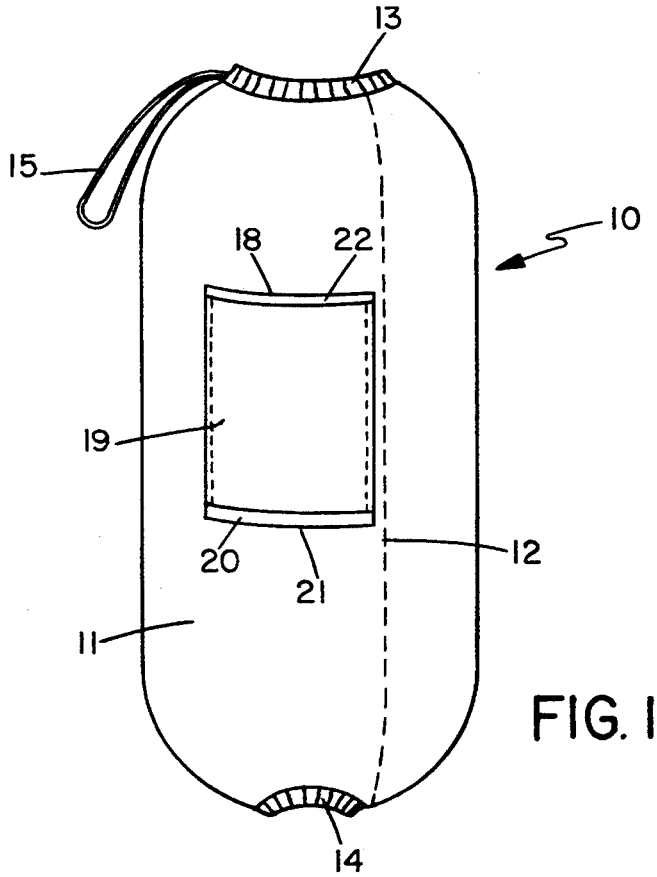
FIG. 1 is a side elevational view of a container according to the present invention.
Figure 2:
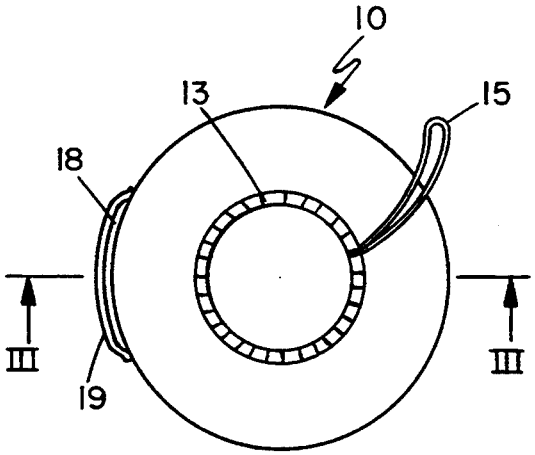
FIG. 2 is a plan view from above corresponding to FIG. 1.
Figure 3:
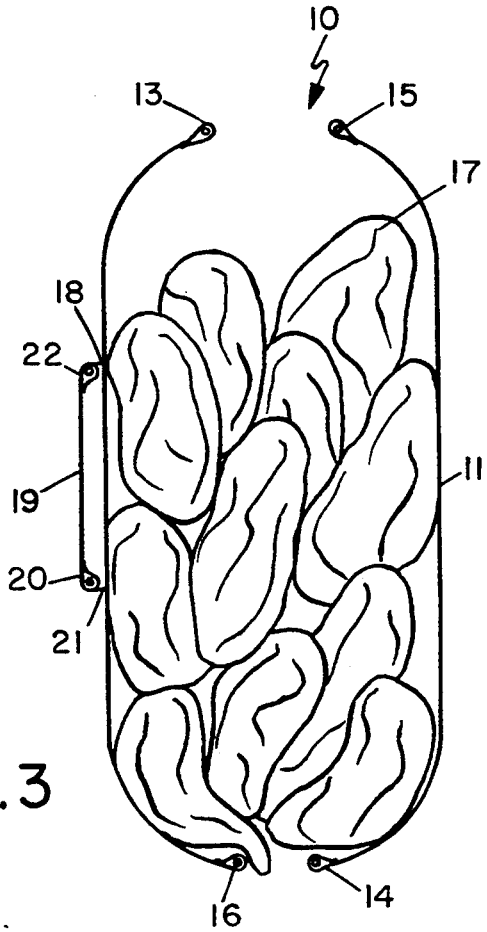
FIG. 3 is a longitudinal cross-sectional view along the line III—III of FIG. 2.

The container 10 is formed from a rectangular sheet of a cotton fabric 11 measuring approximately 380 mm by 540 mm. The side edges of the fabric are sewn together in a seam 12 to form a tube. The tube is turned over at each end to form a casing 13 at an inlet end of the container 10 and a casing 14 at the outlet end of the container 10.

A drawstring 15 is threaded through the casing 13 while a band of elastic 16 is threaded through the casing 14. The band of elastic 16 is drawn sufficiently tight in the casing 14 that the outlet aperture normally has a diameter of about 20 mm but can be expanded against the bias of the band of elastic to have a diameter of 50 mm.

In use the drawstring 15 is loosened to allow plastic film shopping bags 17 to be stuffed into the container 10. When needed the bags can be withdrawn through the outlet aperture of the container 10 one at a time. During storage the plastic film shopping bags are neatly and conveniently retained in the container 10.

A pocket 19 is sewn to the outside of the container 10 leaving unsewn portions at the top and bottom ends so as to respectively form a pocket inlet 18 and a pocket outlet 21. A portion of elastic 20 is included at the outlet 21 so as to restrict the size of outlet 21 in a resilient manner similar to that of the elastic collar 16 in the main body of the container 10. A second portion of elastic 22 is included at the inlet 18 so as to maintain the inlet 18 lightly closed and neat even when the pocket 19 is full.

While pocket 19 is conveniently attached to the outside of the main body 10 of the container, it can be attached to the inside and "post box" type slots formed in the main body of the container 10 to provide the inlet and outlet pocket apertures 18 and 21. Also, further pockets could be used where it was desired to separately store more than two different types of plastic bags.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A container for containing plastic bags comprising:

a tubular body of flexible material forming a first container for bags, said body having open, opposite ends to receive and dispense bags, each of said ends having means for selectively reducing the size of the openings to restrict movement of bags out of said first container, and at least one of said means being resilient to facilitate pulling one bag at a time through the dispensing opening, a second container for containing bags comprising a panel of flexible material secured at opposite sides to the outside of said body with at least portions of the other opposite ends being unsecured and open, said unsecured ends having resilient means for resiliently, partially closing the openings at each end of the panel, forming a pass-through second container with restrictable openings for receiving and dispensing bags, said second container being smaller than said first container.

2. A container for containing plastic bags as claimed in claim 1 wherein:

one of said openings for receiving bags into said first container having a drawstring for selectively restricting the opening.

3. A container for containing plastic bags as claimed in claim 1 wherein:

said flexible material being non-resilient.

4. A container for containing plastic bags as claimed in claim 1 wherein:

said second container having a substantially smaller in diameter container space and a substantially shorter container space than said first container.

5. A container for containing plastic bags as claimed in claim 1 wherein:

said resilient openings comprising elastic cuffs.

6. A container for containing plastic bags as claimed in claim 1 wherein:

the dispensing opening of said second container having an elastic restrictable opening for facilitating pulling one bag at a time through said opening.

7. A container for containing plastic bags as claimed in claim 1 wherein:

the second container is mounted to the outside surface of the first container.

* * * * *